United States Patent [19]

Bloomfield, III

[11] Patent Number: 4,548,148

[45] Date of Patent: Oct. 22, 1985

[54] GLASS BOTTOM BOAT

[76] Inventor: John W. Bloomfield, III, P.O. Box 6427, Hilton Head Island, S.C. 29938

[21] Appl. No.: 460,894

[22] Filed: Jan. 25, 1983

[51] Int. Cl.[4] ..... B63B 35/00

[52] U.S. Cl. ..... 114/66; 114/61; 114/125

[58] Field of Search ..... 440/38, 39, 5; 441/135; 114/56, 61, 66, 125, 333

[56] References Cited

U.S. PATENT DOCUMENTS

| | | | |
|---|---|---|---|
| 1,270,094 | 6/1918 | Arsenault | 114/66 |
| 1,591,341 | 7/1926 | Stiles | 114/66 |
| 1,716,400 | 6/1929 | Weis | 440/38 |
| 1,786,091 | 12/1930 | Stiles | 114/66 |
| 3,335,685 | 8/1967 | Gimbel | 114/66 |
| 3,495,562 | 2/1970 | Fahlman | 114/333 |
| 3,499,409 | 3/1970 | Bernhard | 114/61 |
| 3,680,515 | 8/1972 | Yoneda | 114/66 |
| 3,726,245 | 4/1973 | Critcher | 114/61 |
| 4,411,213 | 10/1983 | Laukien | 114/61 |

FOREIGN PATENT DOCUMENTS

| | | | |
|---|---|---|---|
| 55-51680 | 4/1980 | Japan | 114/125 |
| 164585 | 12/1980 | Japan | 114/61 |

*Primary Examiner*—Jesus D. Sotelo

*Attorney, Agent, or Firm*—Harvey B. Jacobson

[57] ABSTRACT

A catamaran boat is provided including a pair of laterally spaced apart longitudinally extending displacement-type hollow hulls. Generally horizontal connecting deck structure extends between the hulls and includes a large plan area transparent generally horizontal viewing panel supported therefrom in an opening provided in the deck structure. The boat has a loaded operational water line which is spaced below the transparent panel and the hulls include buoyancy varying structure operative to selectively flood the hulls to reduce the buoyancy thereof and raise the water line to a level above the panel and to subsequently pump out the hulls to increase the buoyancy thereof and lower the water line to the aforementioned operational water line. The area immediately above the transparent panel is of water tight integrity when the water line is raised to a level above the viewing panel and the buoyancy varying structure includes below operational water line level intake ports and outlet nozzles functional to provide low speed propulsion and maneuvering of the boat.

6 Claims, 5 Drawing Figures

2
10
38
14
4
4
38
2
28

3
10
12
40
32
20
26
16
72
28
14
40
72
28
3

GLASS BOTTOM BOAT

BACKGROUND OF THE INVENTION

Many glass bottom boats heretofore have been provided for underwater sightseeing and skin diving viewing purposes. However, most previously known glass bottom boats are designed for slow speed operation and may not be safely piloted at medium and high speeds. Accordingly, underwater sightseeing and skin diving viewing in area remote from populated areas are not as developed as they might be, due to the fact that transport from a boarding area to an underwater viewing area takes excessive time and consumes considerable fuel if such a trip is carried out a slow speeds.

Accordingly, a need exists for improved form of boat having an underwater viewing window therein and which may be piloted longer than short distances at medium or high speeds.

Examples of various types of boat hulls including some of the general structural and operational features of the instant invention are disclosed in U.S. Pat. Nos. 2,950,699, 3,045,263, 3,384,043, 3,437,067, 3,830,178 and 4,345,533.

BRIEF DESCRIPTION OF THE INVENTION

The boat of the instant invention is in the form of a catamaran including a pair of laterally spaced longitudinal hulls of the displacement type as well as a horizontal connecting structure extending between the hulls and provided with a large plan area opening therein over which a transparent panel is supported in a water tight manner for underwater viewing.

The boat includes a loaded operational water line which is spaced below the transparent panel and the hulls include structure which is operative to selectively flood the hulls in order to reduce the buoyancy thereof and to raise the water line to a level spaced above the transparent panel while maintaining the water tight integrity of the area above the water tight transparent panel. Of course, the buoyancy varying structure is also operative to subsequently pump out the hulls in order to return the water line of the boat to the aforementioned loaded operational water line.

Each of the hulls includes front and rear water intaking means and forward forwardly facing the water outlet nozzles as well as rear rearwardly facing outlet nozzles and the structure by which water may be pumped into the hulls and outwardly therefrom is also operative to pump water into the hulls while at the same time pumping water from the hulls at the same rate through the outlet nozzles. Accordingly, the buoyancy varying structure may also be used to propel and maneuver the boat at slow speeds.

The main object of this invention is to provide a boat of the glass bottom type for underwater viewing and yet constructed in a manner whereby the underwater viewing window thereof is disposed above the loaded operational water level of the boat. In this manner, the boat may transport underwater viewers over reasonable distances at medium to high speeds at a savings of time and fuel.

Another object of this invention is to provide a boat in accordance with the preceding objects and including structure whereby various hull portions thereof may be flooded to raise the water line to a level above the window and with the water tight integrity of the area above the window maintained.

Still another object of this invention is to provide a boat including structure by which slow speed propulsion and maneuvering of boat may be effected by water jets at an underwater viewing area.

A final object of this invention to be specifically enumerated herein is to provide a boat in accordance with the preceding objects and which will conform to conventional forms of manufacture, be of simple construction and easy to use so as to provide a device that will be economically feasible, long lasting and relatively trouble free in operations.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
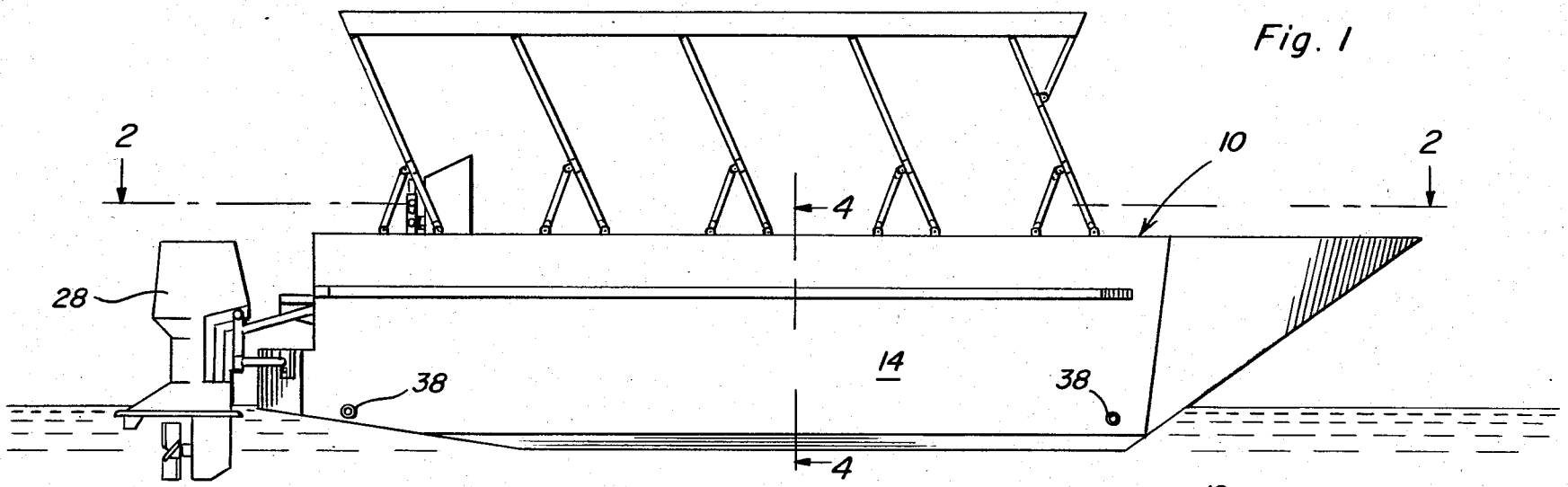
FIG. 1 is a side elevational view of the boat of the instant invention as seen from the starboard side thereof and with the water line of the boat disposed at the loaded operational water line.
Figure 2:
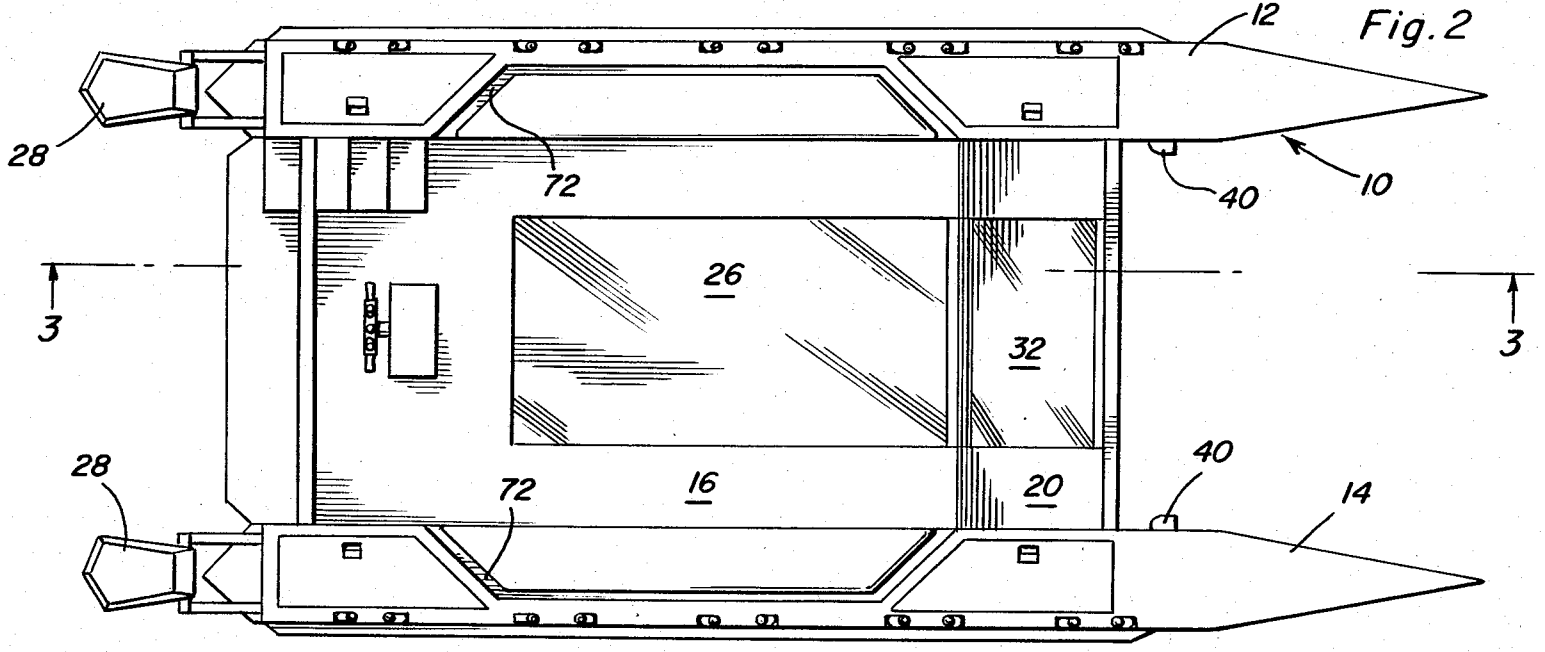
FIG. 2 is a horizontal sectional view taken substantially upon the plane indicated by the section line 2—2 of FIG. 1.
Figure 4:
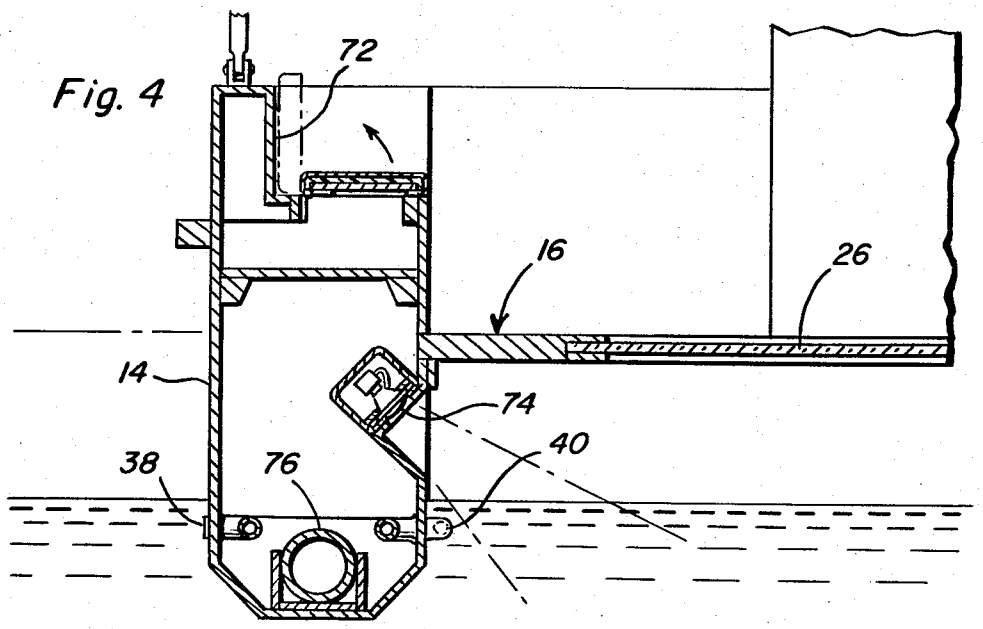
FIG. 4 is an enlarged transverse vertical sectional view taken substantially upon the plane indicated by the section line 4—4 of FIG. 1.

Referring now more specifically to the drawings, the numeral 10 generally designates the boat of the instant invention. From a comparison of FIGS. 1 and 2 of the drawings, it may be seen that the boat 10 includes a pair of laterally spaced apart port and starboard hulls 12 and 14 and that a horizontal hull connecting deck structure referred to in general by the reference numeral 16, see FIG. 4, extends between and interconnects the hulls 12 and 14. The deck structure 16 includes a rear upstanding wall 18 projecting upwardly from the rear marginal edge of the deck structure 16 and extending between the rear ends of the hulls 12 and 14. In addition, a forwardly and upwardly inclined panel structure forms a forward continuation of the forward marginal edge of the deck structure 16 and extends between the forward portions of the hulls 12 and 14.

The boat 10 includes a loaded operational water line 22 which is spaced considerably below the deck structure 16. The latter includes a large plan area opening 24 therein in which a transparent panel or window 26 is sealingly secured. Although the size of the boat 10 as well as the height of the window 26 above the water line 22 may vary, for illustrative purposes it may be said that the boat is approximately 26 feet in overall length, 12½ feet in overall width and that the transparent panel 26 is spaced approximately 1½ feet above the water line 22 when the boat 10 is fueled and has its rated passanger capacity aboard. Accordingly, when under way at medium or high speeds, as a result of operation of the outboard motors 28 mounted on the stern portions of the hulls 12 and 14, the water line 22 will be spaced more than 1½ feet below the transparent panel or window 26. The panel section 20 also includes a large plan area opening 30 therein and a transparent panel or window 32 is sealingly mounted within the opening 30.

Each of the hulls 12 and 14 includes front and rear water pumping structure referred to in general by the reference numeral 36. Each water pumping structure 36 includes a water inlet port 38 opening through an adjacent outer hull side portion, a discharge nozzle 40 opening outwardly through an adjacent inner hull side portion. The forward nozzles 40 open forwardly while the rear nozzle 40 opens rearwardly. In addition, each structure 36 includes a high volume centrifugal pump 42 driven by an electric motor and each of the inlet ports 38 is communicated with the intake of the associated pump 42 by a suction line 44 equipped with a manual shut-off valve 46 adjacent the port 38 and an electrically controlled valve 48. In addition, each of the discharge nozzles is connected to the discharge end of a discharge line 50 extending from the outlet of the associated pump 42 and having a manual shut-off valve 52 serially connected therein adjacent the discharge nozzle 40 and an electrically actuated control valve 54 disposed therein intermediate the valve 52 and the pump outlet. Still further, each water pump structure 36 includes a hull flooding line 56 which may be communicated with the discharge of the pump 42 by an electrically controlled valve 58 and a hull pump out line 60 which may be communicated with the intake of the pump 42 by an electrically controlled valve 62. In addition, the motor 42 and valves 58 and 54 are under the control of an override control in the form of a float 64. Otherwise, the pump motors and various valves are under the control of a valve and pump logic control 66, a jet propulsion logic control 68 and a manual control 70 in the form of a joist stick control.

The hulls 12 and 14 may be flooded by operation of all of the pumps 42 to draw water inward through the lines 44 and discharging that water through the lines 56 into the interior of the hulls 12 and 14. When the water level within the hulls 12 and 14 reaches a predetermined level, operation of the pumps 42 is automatically terminated and the valves 48 and 58 are closed. If for any reason, the water level within the hulls 12 and 14 raises above the desired flooded level thereof, the float 64 will be operative to initiate operation of the pump motors and to open the valves 54 and 62.

Figure 3:
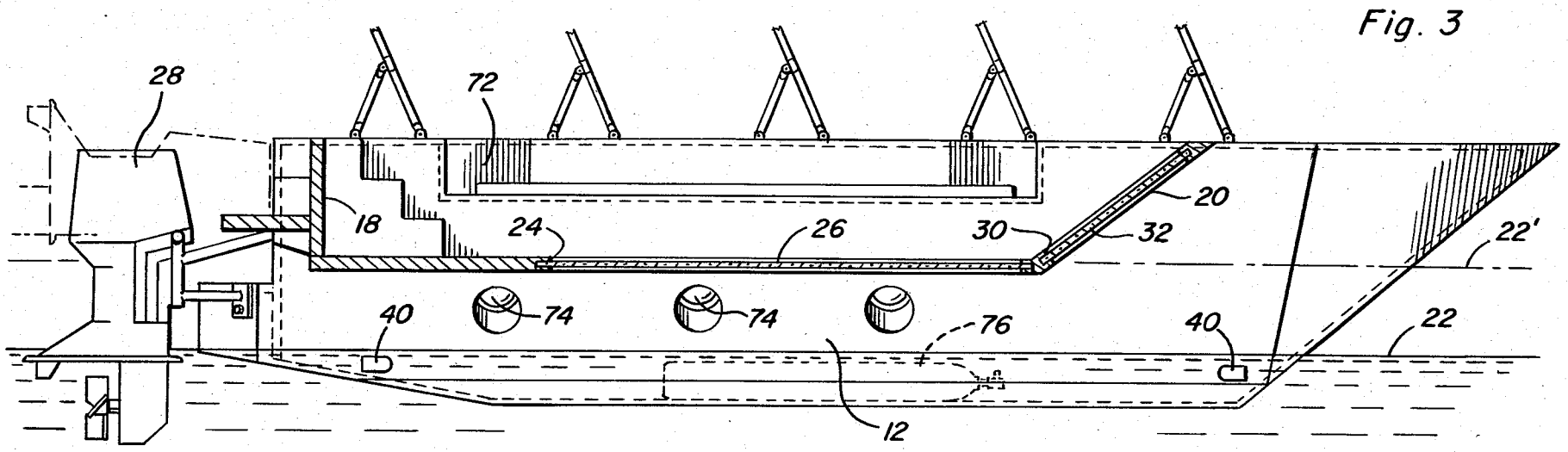
FIG. 3 is an enlarged longitudinal vertical sectional view taken substantially upon the plane indicated by the section line 3—3 of FIG. 2.
Figure 5:
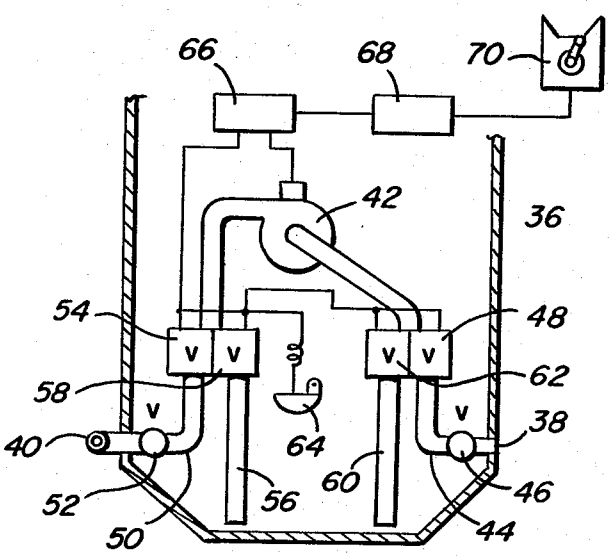
FIG. 5 is a fragmentary enlarged vertical sectional view of a forward portion of the starboard hull of the boat and with the associated water pumping system schematically illustrated.

When the hulls 12 and 14 are flooded to the desired level, the water line of the boat 10 is raised to the level 22' illustrated in FIG. 3 whereby the water level is elevated to a point above the transparent panel 26. The upper inner side portions of the hulls 12 and 14 have recesses 72 formed therein defining inwardly facing seating areas upon which underwater viewers may be seated for viewing the area beneath the panel 26 when the water line of the boat 10 is disposed at the level 22'. In addition, the inner sides of the hulls 12 and 14 include inwardly and downwardly inclined underwater lights 74 for illuminating the underwater areas which may be viewed through the panel 26 and the interior portions of the hulls 12 and 14 may include compressed air or gas tanks 76 for refilling underwater breathing apparatus, the tanks 76 may be contained within water tight compartments which are not floodable.

Although the boat 10 is illustrated as including main propulsion means in the form of outboard motors 28, it is to be noted that the boat 10 could be constructed of considerably larger dimensions and include inboard power. However, such inboard power would be mounted within compartments within the hulls 12 and 14 which may not be flooded.

After the boat 10 has reached an underwater viewing area and it is not desired to operate the outboard motors 28 in the interest of saving fuel and also for safety reasons when underwater swimmers are disposed in areas adjacent the boat 10, the electrically driven pumps 42 may be used to propel and maneuver the boat 10. If it is desired to propel the boat forwardly, the rear water pump structures 36 are actuated with the valves 58 and 62 closed and the valve 48 and 54 open. This, of course, will cause rearward jets of water to be discharged from the rear jet nozzles 40. On the other hand, if it is desired to propel the boat rearwardly, the forward water pump structures 36 are actuated with their valves 58 and 62 closed and the associated valves 48 and 54 open. This will cause forward jets of water to be discharged from the forward jet nozzles 40. Of course, the water pump structures 36 in each hull 12 and 14 may be similarly selectively actuated in order to enable maneuvering.

It is pointed out that as soon as the water line is raised to a level flush with the undersurface of the deck structure 18, further raising of the water line greatly increases the buoyancy of the boat 10. Hence, the structure of the instant invention comprises an improvement over similar structure wherein the deck structure is merely lowered relative to the hulls 12 and 14 to a level slightly below the water line 22.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A boat including a pair of laterally spaced apart longitudinally extending displacement-type hollow hulls and horizontal connecting structure extending between and interconnecting the hulls to form a unitary buoyant structure, said connecting structure including a large plan area transparent and generally horizontal viewing panel supported therefrom, said boat having a loaded operational water line spaced below said transparent panel, buoyancy varying means operative to selectively flood portions of said hollow hulls to reduce the buoyancy of said hulls and raise said water line to a line above said viewing panel and subsequently pump out said hollow hulls to lower said water line back to said loaded operational water line, the adjacent sides of said hulls and said connecting structure coacting to form an area immediately above said viewing panel of water tight integrity, even when said water line is raised to said level above said viewing panel, said hulls each including inner and outer side portions spaced below said operational water line, said buoyancy varying means including front and rear intake ports formed in front and rear end potions of each of said outer side portions below said water line and forwardly and rearwardly discharging outlet nozzles supported from front and rear portions, respectively, of each of said inner side portions below said water line.

2. The boat of claim 1 wherein said buoyancy varying means also includes means for intaking water through selected intake ports and discharging equal amounts of water from corresponding outlet nozzles.

3. The boat of claim 1 wherein said buoyancy varying means also includes means operative to automatically pump water from within said hollow hull portions responsive to an increase of water level therein above a predetermined maximum level.

4. The boat of claim 1 wherein the inner sides of the portions of said hulls disposed below said connecting structure include inwardly and downwardly directed lights for illuminating underwater areas being viewed through said transparent panel when said water level is raised above the level of said viewing panel.

5. A boat including a pair of laterally spaced apart longitudinally extending displacement-type hollow hulls and horizontal connecting structure extending between and interconnecting the hulls to form a unitary buoyant structure, said connecting structure including a large plan area transparent and generally horizontal viewing panel supported therefrom, said boat having a loaded operational water line spaced below said transparent panel, buoyancy varying means operative to selectively flood portions of said hollow hulls to reduce the buoyancy of said hulls and raise said water line to a line above said viewing panel and subsequently pump out said hollow hulls to lower said water line back to said loaded operational water line, the adjacent sides of said hulls and said connecting structure coacting to form an area immediately above said viewing panel of water tight integrity, even when said water line is raised to said level above said viewing panel, the inner sides of the portions of said hulls disposed below said connecting structure including inwardly and downwardly directed lights for illuminating underwater areas being viewed through said transparent panel when said water level is raised above the level of said viewing panel, said hulls comprising longitudinal hull members of a catamaran-type boat and the inside gunnel portions of said hull members including upwardly opening relieved areas defining seating areas facing toward said viewing panel, said panel being disposed at a level below said relieved areas, said hulls each including inner and outer side portions spaced below said operational water line, said buoyancy varying means including front and rear intake ports formed in front and rear end portions of each of said outer side below water level portions and forwardly and rearwardly discharging outlet nozzles supported from front and rear portions, respectively, of each of said inner side below water level portions.

6. The boat of claim 5 wherein said buoyancy varying means also includes means for intaking water through selected intake ports and discharging equal amount of water from corresponding outlet nozzles.

* * * * *